United States Patent [19]

Styring, Jr.

[11] 4,314,899

[45] Feb. 9, 1982

[54] SEPARATING SPENT MINERAL MATTER FROM HEAT CARRIERS

[75] Inventor: Ralph E. Styring, Jr., Dallas, Tex.

[73] Assignee: Atlantic Richfield Company, Los Angeles, Calif.

[21] Appl. No.: 220,006

[22] Filed: Dec. 23, 1980

[51] Int. Cl.[3] ..... B07B 11/06; B07B 9/02

[52] U.S. Cl. ..... 208/11 R; 209/138; 208/8 R

[58] Field of Search ..... 208/11 R; 209/20, 138, 209/139 R, 147, 149

[56] References Cited

U.S. PATENT DOCUMENTS

| | | | |
|---|---|---|---|
| 3,104,155 | 10/1963 | Lewis | 209/138 |
| 3,295,677 | 1/1967 | Condolios | 209/138 |
| 4,152,245 | 5/1979 | Abdul-Rahman et al. | 208/11 R |

*Primary Examiner*—Delbert E. Gantz
*Assistant Examiner*—Glenn A. Caldarola
*Attorney, Agent, or Firm*—M. David Folzenlogen

[57] ABSTRACT

In the pyrolysis of crushed mined hydrocarbonaceous mineral solids with hot heat carrying solids, the heat carrying solids are recovered from the pyrolyzed mineral matter, heated and recycled back to a primary pyrolysis zone. At an appropriate point in the process, a mixture of heat carriers and pyrolyzed mineral matter is fed into a chamber through which an elutriating gas is flowed. Prior to entry into the chamber, the mixture is separated into two streams having different relative concentrations of spent mineral matter. The stream with the least amount of spent mineral matter is fed into the chamber at a point below the point where the stream with the larger amount of spent mineral matter is fed. This prevents surging of the elutriation system.

1 Claim, 2 Drawing Figures

SEPARATING SPENT MINERAL MATTER FROM HEAT CARRIERS

BACKGROUND OF THE INVENTION

The invention relates to a process for retorting the hydrocarbonaceous organic matter in crushed mined solids using recycled hot heat carrying solids. More particularly, this process relates to a novel method for feeding a mixture of heat carriers and pyrolyzed mineral matter to an elutriating system.

Many processes have been suggested for retorting the carbonaceous organic matter in oil shale, coal and tar sands. Some of these processes involve heating solids and using these solids as heat carriers. The hot heat carriers and crushed mined hydrocarbonaceous mineral matter are mixed in a primary pyrolysis zone. The heat in the hot heat carriers provides much of the retoring energy. Eventually, the heat carriers are separated from the pyrolyzed mineral residue and the heat carriers are recycled through the process.

It is desirable that most of the spent mineral matter, especially fine materials like ash and dust be removed from the recycled heat carriers. This is frequently accomplished by gas elutriation. For example, in U.S. Pat. Nos. 3,803,022 and 3,844,929, the retorting stage uses special pellets as heat carriers and these carriers are separated in a primary separation stage followed by a secondary gas elutriation stage. In U.S. Pat. No. 3,164,541, the retort uses heated balls. The mineral fines and ash are separated by hot combustion gases flowing through a bed of balls in a ball heater. In U.S. Pat. No. 3,691,056, a mixture of heat carriers and pyrolyzed oil shale is fed to a fluidized bed combustion zone. When the residual organic matter is burned, the oil shale solids split and are elutriated by the combustion gas.

In all of these prior processes, a mixture of heat carrying solids and spent mineral matter is fed into some sort of chamber through which gas is flowed and the gas carrys fine mineral matter out of the chamber above the point where the mixture is fed. For purposes of this disclosure, this gas is called an elutriating gas.

When a multiple layer mixture of heat carriers and fine spent mineral matter is passed through a conveying system, for example, a gravity fed chute, the finer matter tends to form in one multiple layer stratum while the heat carriers tend to form in another stratum. When the mixture is fed into an elutriating chamber, this tends to cause surging, poor separating efficiency, and sometimes carry over of heat carriers with the fine mineral matter.

SUMMARY OF THE INVENTION

The separating efficiency of a gas elutriation stage wherein spent mineral matter and heat carriers are separated is improved by first separating a mixture of the heat carriers and pyrolyzed mineral matter into at least two streams. One stream has a greater concentration of heat carriers than the mixture and greater than the other separated stream. The other separated stream has a greater concentration of pyrolyzed mineral matter than the mixture. Both streams are fed into the same elutriating chamber. The stream with the greater concentration of heat carriers is fed at a point below the point where the stream with the lesser concentration of heat carriers is fed. This reduces surging of the elutriation chamber.

DETAILED DESCRIPTION OF PREFERRED EMBODIMENTS

The following description of this invention will refer to a typical gravity fed elutriation chamber for cleaning dust and small mineral matter from larger heat carrying solids. The heat carrying solids and pyrolyzed mineral matter were produced in the retorting stage of a petroleum producing facility. In processes of this nature, the heat carrying solids are recovered, reheated and recycled through the retorting process and it is desirable that the heat carrying solids be relatively free of fine spent mineral matter when the solids are reheated.

Briefly, the process of the invention is comprised of separating a mixture of heat carrier solids and pyrolyzed mineral matter into at least two streams. This pyrolyzed mineral matter contains a significant amount of pyrolyzed matter smaller in size than the heat carrier solids. The first stream has a greater relative concentration of heat carrier solids than the original mixture. The second stream has a greater relative concentration of pyrolyzed mineral matter than the original mixture. The two streams are then passed in a special manner to a chamber through which a gas is flowed at a velocity sufficient to elutriate a significant portion of the spent mineral smaller in size than the heat carriers. The first stream which has the greater concentration of heat carriers is passed into the elutriation chamber at a point vertically lower than the point where the second stream is passed into the chamber. The fine spent mineral matter is thereby elutriated in a way that reduces surging of the elutriation chamber.

Figure 1:
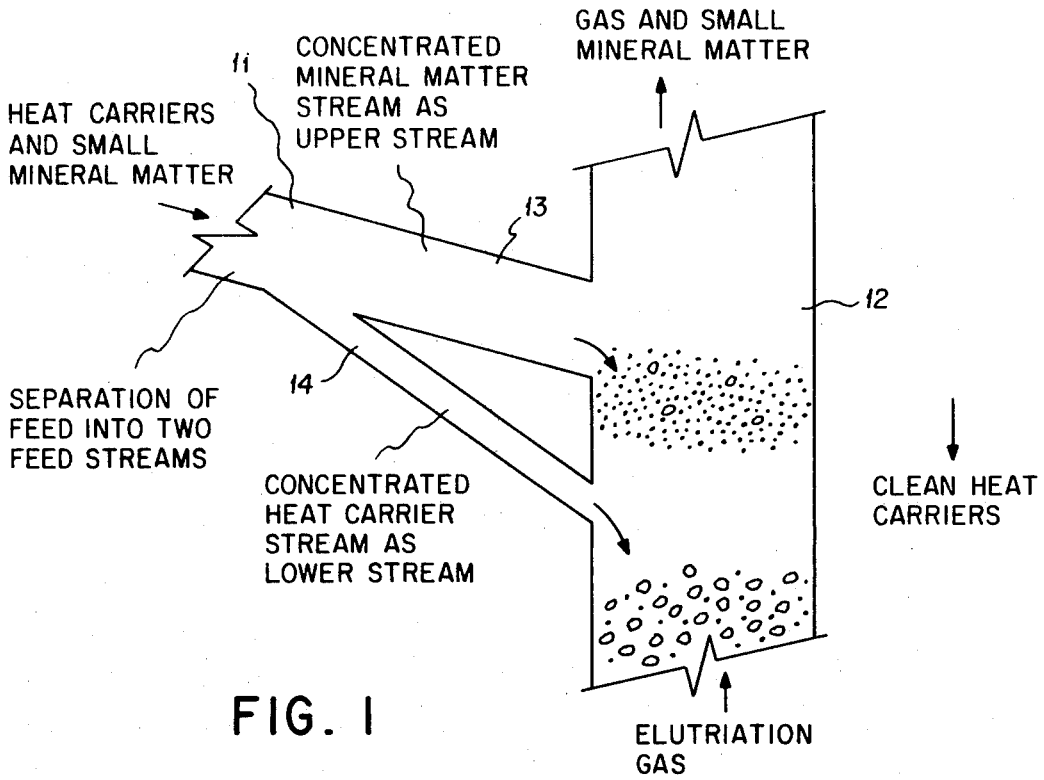
FIG. 1 illustrates the basic steps of this invention where a mixture of heat carriers and mineral matter is separated into two streams and the streams fed at different points into the same gas elutriation chamber.

More particularly, in FIG. 1, at an appropriate point in a retorting system, a mixture of heat carriers and pyrolyzed mineral matter smaller than the heat carriers is passed by gravity through chute or conduit 11. As the solids move, the solids form multiple layer stratum. The small pyrolyzed mineral concentrates itself into the lower stratum of solids, thereby forming a lower stratum of solids having a greater concentration of spent mineral matter than the upper stratum. If these stratum were fed into elutriation chamber 12, the lower stratum rich in small pyrolyzed mineral matter would be below the upper stratum. An upwardly flowed elutration gas would need to carry the finer mineral matter upward through multiple layers of heat carriers. In the system herein described, this natural feeding of the solids into an elutration chamber is inverted by separating the mixture in conduit 11 into two streams of different relative concentrations of smaller pyrolyzed mineral matter. The stream having the greater concentration of small pyrolyzed mineral matter is fed through top inlet conduit 13 into chamber 12. The stream having the lesser concentration of smaller pyrolyzed mineral matter and the greater concentration of heat carriers is fed through lower inlet conduit 14 into the elutriating chamber. This is illustrated in FIG. 1 by small circles representing heat carriers and small black dots representing smaller pyrolyzed mineral matter.

An elutriating gas in fed upwardly through chamber 12 and it can be seen that the smaller spent mineral matter can readily be carried upward out of the chamber.

Figure 2:
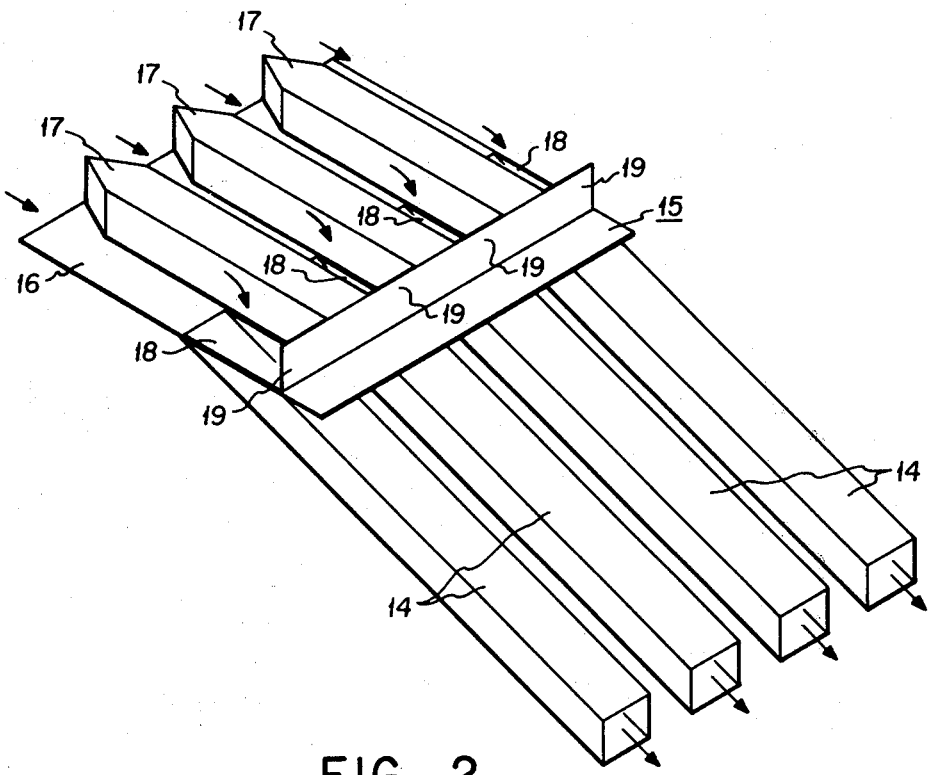
FIG. 2 illustrates one system for inverting the relative vertical position of solids in a mixture flowing through a gravity fed chute.

One apparatus 15 for separating the mixture of solids in conduit 11 into two streams and inverting the natural feed of the solids is shown in FIG. 2. The upper end of separating apparatus 15 is designed to be inserted into conduit 11. Separating apparatus 15 has thin dividing or separating sheet 16 which, when positioned in conduit 11, is designed to extend parallel to the lower side of conduit 11 and to divide the conduit into two vertically spaced conduits. When the mixture of solids flows downward, the solids in the top half of conduit 11 pass over the top side of sheet 16. Longitudinal dividers 17 divide conduit longitudinally and direct the solids above dividing sheet 16 toward openings 18. Solids passing below dividing sheet 16 pass into conduit 13 which is simply an extension of conduit 11.

Connecting with the upper side of dividing sheet 16 are downwardly-sloped inlet conduits 14. These conduits have upper end openings 18 which are adapted to receive solids flowing over sheet 16 and thereby to conduct this solids downwardly into chamber 12 at a point vertically below the point where top inlet conduit 13 enters the chamber. On the downward edge of openings 18 is vertical baffle plate 19 adapted to prevent solids from failing to enter openings 18.

In operation, the solids in the lower stratum in conduit 11 pass under dividing sheet 16 and flow through inlet conduit 13 into chamber 12. The solids in the upper stratum in conduit 11 pass over dividing sheet 16 into openings 18, downwardly through inlet conduits 14, and into chamber 12. This system thereby inverts the normal way that the solids would have been fed into the elutriation chamber.

As the two streams solids are flowed into elutriation chamber 12, an elutriating gas is flowed upward through the solids at a rate sufficient to elutriate at a least a part of the pyrolyzed mineral matter and carrys the elutriated mineral matter up and out of the chamber. The velocity of the elutriating gas is not sufficient to elutriate the heat carriers. The heat carriers thereby fall to the bottom of the chamber. The operation and design of gas elutriators are well known; however, it may be noted that, in addition to the properties of the particles, the elutriation velocity of particular particles depends on the elutriator design including such factors as free board height, bed height and weight, gas type and velocity, column diameter and cross-sectional area, and transport disengaging height.

Reasonable variations and modifications are practical within the scope of this disclosure without departing from the spirit and scope of the claims of this invention.

The embodiments of the invention in which an exclusive property of privilege is claimed are defined as follows:

1. In a method of retorting the hydrocarbonaceous matter in crushed mined hydrocarbonaceous mineral bearing solids wherein said solids are retorted by contacting said solids with hot heat carriers thereby producing a mixture of pyrolyzed mineral matter in said solids and heat carriers and wherein a mixture of said pyrolyzed mineral matter and said heat carriers is fed to a chamber through which an elutriating gas is flowed, the improvement comprising (1) separating a mixture of pyrolyzed mineral matter solids and heat carrier solids into a first and second system, said first stream having a relative concentration of pyrolyzed mineral matter greater than the relative concentration of said pyrolyzed mineral matter in said mixture, said second stream having a relative concentration of heat carrier solids greater than the relative concentration of said heat carriers in said mixture, (2) feeding said first stream into an elutriation chamber at a first point, (3) feeding said second stream into said elutriation chamber at a second point, said second point being vertically lower than said first point, (4) flowing an elutriating gas upwardly through said solids fed into said chamber, and (5) removing at least a part of said pyrolyzed mineral matter from said chamber with said elutriating gas.

* * * * *